US007487622B2

(12) United States Patent
Wang

(10) Patent No.: US 7,487,622 B2
(45) Date of Patent: Feb. 10, 2009

(54) INTERLOCKING FRAME SYSTEM FOR FLOOR AND WALL STRUCTURES

(76) Inventor: Dennis H. Wang, c/o Philip K. Yu, Attorney at Law, 20955 Pathfinder Rd., Ste. 100, Diamond Bar, CA (US) 91765

( * ) Notice: Subject to any disclaimer, the term of this patent is extended or adjusted under 35 U.S.C. 154(b) by 317 days.

(21) Appl. No.: 11/383,839

(22) Filed: May 17, 2006

(65) Prior Publication Data

US 2006/0260223 A1 Nov. 23, 2006

Related U.S. Application Data

(60) Provisional application No. 60/681,837, filed on May 17, 2005.

(51) Int. Cl.

| | |
|---|---|
| ***E04F 15/00*** | (2006.01) |
| ***E04F 13/08*** | (2006.01) |
| ***E04F 15/22*** | (2006.01) |
| ***E04B 2/00*** | (2006.01) |

(52) U.S. Cl. ..... 52/384; 52/385; 52/592.1; 52/591.4; 52/177

(58) Field of Classification Search ..... 52/384, 52/385, 390, 391, 392, 177, 396.04, 396.1, 52/403.1, 664, 668, 59.1, 591.4; 404/18, 404/31, 33, 34, 35, 40, 41, 43; 33/1 G, 526, 33/527, 613, 623, 645

See application file for complete search history.

(56) References Cited

U.S. PATENT DOCUMENTS

| | | | | | |
|---|---|---|---|---|---|
| 3,312,024 | A | * | 4/1967 | Paschmann | 52/220.2 |
| 3,504,472 | A | * | 4/1970 | Clement | 52/477 |
| 3,964,224 | A | * | 6/1976 | Christensen | 52/387 |
| 4,628,645 | A | * | 12/1986 | Tafelski, Jr. | 52/169.1 |
| 4,712,309 | A | * | 12/1987 | Kingston et al. | 33/527 |
| 4,958,814 | A | * | 9/1990 | Johnson | 269/43 |
| 5,241,799 | A | * | 9/1993 | Jahn | 52/506.06 |
| 5,323,575 | A | * | 6/1994 | Yeh | 52/177 |
| 5,465,534 | A | * | 11/1995 | Mittag | 52/126.6 |
| 5,787,663 | A | * | 8/1998 | Wehrmann | 52/263 |
| 5,806,270 | A | * | 9/1998 | Solano et al. | 52/747.11 |
| 5,832,619 | A | * | 11/1998 | Volkema, Jr. | 33/527 |
| 6,042,915 | A | * | 3/2000 | Kessler | 428/45 |
| 6,076,323 | A | * | 6/2000 | Chiu | 52/562 |

(Continued)

OTHER PUBLICATIONS

Advan K.K. Catalog, "Do Reform Yourself," date unknown, published by Advan K.K., Tokyo, Japan.

*Primary Examiner*—Robert J Canfield
*Assistant Examiner*—Brent W Herring
(74) *Attorney, Agent, or Firm*—Alan Kamrath; Kamrath & Associates PA

(57) ABSTRACT

A frame for an interlocking system for floor or wall tiles has a base frame with a lid surrounding its perimeter. The lid serves to fill the gap between frames after the tiles are installed, as well as provide lateral stability to the tiles. The bottom of the base frame has an array or grid of support legs. On at least one side of the perimeter, the base frame has a plurality of bosses or slotted connectors extending outwardly from the base frame, which can be used to make connection with the support legs of another base frame. A filler, or divider, frame, of a given shape, e.g. "+" or "#", is used to guide the placement of the tiles onto the base frame, as well as fill the gap between the tiles. Notches are formed on the base frame to securely engage the filler frame. One set of notches are formed through the surface of the base frame's planar body, white the other set of notches are formed on the inside surface of the lid of the base frame.

12 Claims, 17 Drawing Sheets

U.S. PATENT DOCUMENTS 6,085,477 A * 7/2000 Hiese et al. ..... 52/270
6,467,224 B1 * 10/2002 Bertolini ..... 52/177
6,550,195 B1 * 4/2003 Cooper et al. ..... 52/220.3
6,694,689 B1 * 2/2004 Scott et al. ..... 52/392
6,694,691 B2 * 2/2004 Ku ..... 52/403.1
6,709,350 B1 * 3/2004 Onstad ..... 473/415
6,802,159 B1 * 10/2004 Kotler ..... 52/177
D499,189 S * 11/2004 Collison ..... D25/62
6,966,155 B2 * 11/2005 Nevison ..... 52/177
6,990,777 B2 * 1/2006 Poliacek et al. ..... 52/384
7,114,298 B2 * 10/2006 Kotler ..... 52/177
2002/0102379 A1 * 8/2002 Saltzman et al. ..... 428/45
2003/0089051 A1 * 5/2003 Bertolini ..... 52/177
2003/0177728 A1 * 9/2003 Ku ..... 52/403.1
2004/0177578 A1 * 9/2004 Casimaty ..... 52/384
2004/0216420 A1 * 11/2004 Poliacek et al. ..... 52/747.11
2005/0034395 A1 * 2/2005 Kotler ..... 52/384
2005/0120651 A1 * 6/2005 Lee ..... 52/263
2005/0235588 A1 * 10/2005 Knight ..... 52/263
2005/0252109 A1 * 11/2005 Fuccella et al. ..... 52/177
2006/0265987 A1 * 11/2006 Iannone ..... 52/384
2007/0039267 A1 * 2/2007 Swanson ..... 52/391

* cited by examiner

INTERLOCKING FRAME SYSTEM FOR FLOOR AND WALL STRUCTURES

PRIORITY CLAIM

This patent application claims priority under 35 U.S.C. Sec. 119 (e) Provisional Patent Application No. 60/681,837, filed on May 17, 2005, the contents of which are incorporated herein by reference.

FIELD OF THE INVENTION

The present invention relates to the field of modular floor tiles and modular floor tile systems, and more particularly relates to flexible inter-connectable modular floor or wall tiles systems. The system may be designed as a floor covering for a patio, a deck, a garage, an exterior room or even an interior room, all without affecting the existing drainage system. More particularly, the system may be designed as a wall covering, thus allowing different tile or paneling designs.

BACKGROUND OF THE INVENTION

Modular floor tiles have become more popular, as homeowners find it easier to remodel or extend their living spaces using commonly available tools. For example, to remodel or repair an existing patio floor, it may be necessary to remove the old flooring to ensure proper drainage. However, removing or demolishing an existing floor requires more work than a typical home do-it-yourselfer can do, not to mention the expertise needed for the drainage system.

A company in the Shibuya District, Tokyo, Japan has developed an interconnected frame system for remodeling an existing floor or deck. The company, ADVAN K.K., uses interlocking frames, on which tiles, panels or trimmings are glued, to cover an existing floor, without having to remove the existing floor. The interlocking frames essentially provide a "floating" layer of tiles so that the existing drainage can still be utilized as water drains through the gaps between the interlocking frames. As illustrated in its "DO REFORM YOURSELF" catalog, of which the contents are incorporated herein by reference, the ADVAN frame system seeks to beautify damaged or dilapidated areas by providing an overlaying cover. Each frame is 30 cm×30 cm×2.3 cm, but each frame can accommodate tiles ranging from 1, 4, or 9 pieces. More importantly, each frame, mostly made of plastic material, can be cut to fit the precise dimension of the floor space. Each frame can be interconnected with another frame using their legs and bosses underneath.

The ADVAN system, however, still has its drawbacks. First, since each frame is a flat structure with legs and bosses at the bottom, the tiles tend to shift sideways even after they are glued to the frame. Also, in the case of a 2×2 or 3×3 tile arrangement, there is a gap between each tile and between each frame, exacerbating the lateral movement of the tiles. Such gaps cannot be filled by grouting, since it would affect the drainage design, as well as cause the tiles to crack. Additionally, each frame has only limited number of legs and bosses for interconnecting points around one or two edges of the frame. In many applications, when the frame is trimmed to fit a certain dimension, no interconnection points are left, thus limiting the versatility of the frame. In many situations, after a frame is cut or trimmed into smaller pieces, the only usable piece that remains is the one still with the legs for connection with the bosses.

Another conventional modular floor system is disclosed in US Patent Application Publication by Fuccella et al., US2005/0252109. This system discloses an interconnected flooring system, which does not provide for support of the tiles or panels. Nor does it provide for varying tile designs from frame to frame. Its piece has a slanted angle and cannot be trimmed to make size adjustments.

Therefore, it is desirable to have an interlocking frame system that can support any kind of tiles or panels overlaying an existing floor surface.

It is also desirable to have an interlocking frame system that can prevent lateral shifting of the tiles on top of the interconnected frames.

It is further desirable to have an interlocking frame system that can provide a floating cover over an existing floor surface without affecting the existing drainage.

SUMMARY OF THE INVENTION

An interlocking modular frame system for floor and wall structures is disclosed. The system uses a plastics base frame as underlying structure for various material such as tiles, wood, granite, sandstone, marbles, and other natural or man-made materials (hereinafter refers to as "tile"). It will work by itself as well. The modular frame system will also accommodate various sizes to create special patterns or a more natural look. The underlying "BASE FRAME" forms the basis of the system. The base frame will hold each tile in place, so that the systems is created by using the interlocking mechanism of the base frame. It is basically a "floating" floor system that does not need to be directly nailed, cemented, or glued to the existing hard surface. The plastic under-layer has ventilation gaps designed into its bottom and sides, so that it also works as a drainage system. This ventilation and drainage mechanism is created by "legs" or "bosses" on the bottom side of the base frame. The pieces are connected by the specially designed edges with slotted holes and bosses that connect and lock each piece in place.

A new surface is formed by inter-connecting multiple pieces of the base frame. The connectors in each base frame will connect and lock into place to form a sheet.

The invention discloses a universal system that uses off-the-shelf products as well as specially designed products/tiles. This modular system can be installed on the floor as well as the walls. The existing surface preferably needs to be properly drained and is essentially a hard surface. The present invention is easy, fast, no mess, flexible, and versatile and does not require special skills or knowledge to put the systems together. Removal of existing flooring or wall coverings is not needed. This product is designed for a quick facelift. It goes directly over the existing surface or material without affecting its original slope or drainage.

The edges can also be finished with a "edge cap". This edge cap acts as the finish for edges if desired, and it can be trimmed to size with a knife.

One embodiment of the modular frame in accordance with the present invention has a base frame with a lid surrounding its perimeter. The lid serves to fill the gap between frames after the tiles are installed, as well as provide lateral stability to the tiles. The bottom of the base frame has an array or grid of support legs. On at least one side of the perimeter, the base frame has a plurality of bosses or slotted connectors extending outwardly from the base frame, which can be used to make connection with the support legs of another base frame. A filler, or divider, frame of a given shape, e.g. "+" or "#", is used to guide the placement of the tiles onto the base frame, as well as fill the gap between the tiles. Notches are formed on the base frame to securely engage the filler frame. One set of notches are formed through the surface of the base frame's planar body, while the other set of notches are formed on the inside surface of the lid of the base frame.

BRIEF DESCRIPTION OF THE DRAWINGS

FIG. 2 (*b*) shows the 2×2 arrangement of tiles 22 in the "tray-shaped" frame 10. The filler frame 25 serves as a "gap-filler" as well as a stabilizer.

FIG. 4 (*b*) shows the 3×3 arrangement of tiles in the frame 10. FIGS. 4 (*c*)-(*d*) show the 3×3 arrangement in closer detail.

DETAILED DESCRIPTION OF THE PREFERRED EMBODIMENTS

An interlocking modular frame system for floor and wall tiles is disclosed.

Figure 1A:
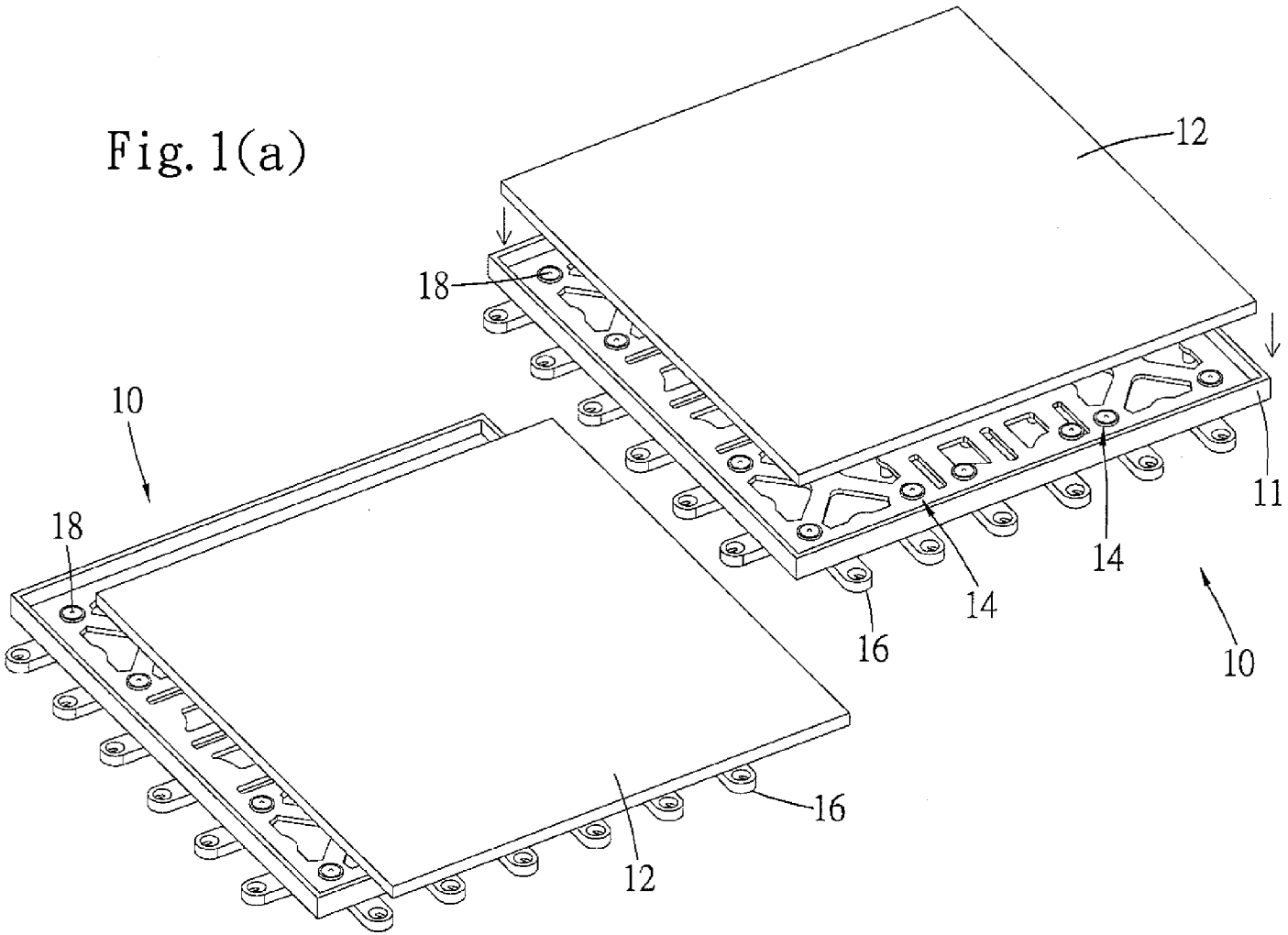
FIGS. 1 (*a*) and (*b*) show two modular frames in accordance with the present invention.
Figure 1B:
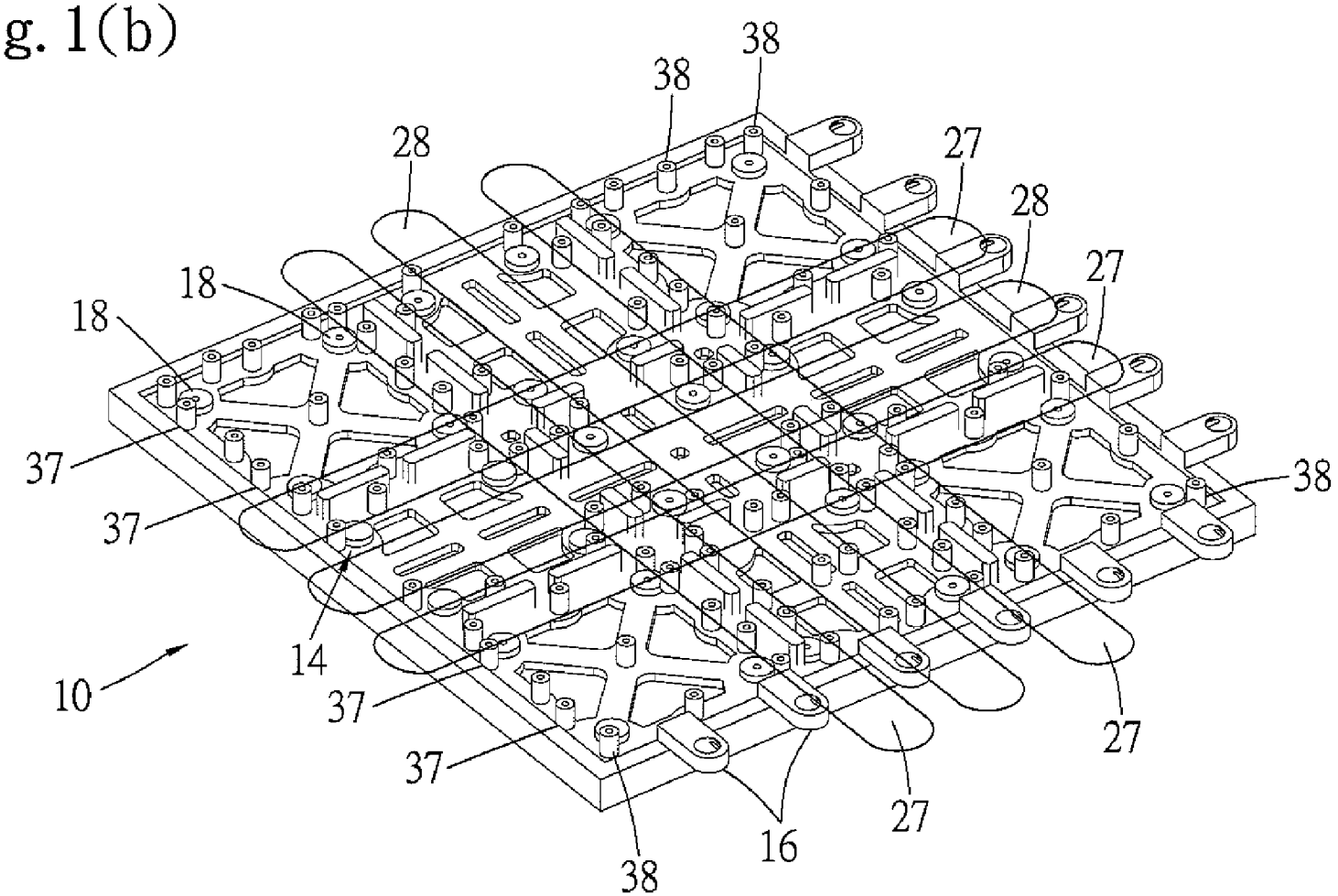

Reference is first to FIG. 1 (*a*), where two modular frames 10 in accordance with the present invention is shown. The frames 10 can be interconnected by coupling the bosses 16 on one edge of one frame to the legs 37 (not shown) underneath the other frame. The frame 10 has a planar member with a raised edge 11 around its perimeter, thus forming a "tray-shaped" structure for supporting the tile 12. Glue holes 14 with overflow are dispersed throughout the surface of the frame 10, which can be filled with adhesive material that will bond to the tile 12 when it is in place. Nail or screw holes 18 may also be provided for attaching the frame 10 to the ground or to the wall, whatever the intended design is. For installation, the frames may be first placed over an area to be covered. Tiles of various designs or dimensions may then be applied to the frames using adhesives.

As can be appreciated, since the frame 10 has a raised edge around its perimeter, it prevents any lateral movement of the tile 12. Additionally, when two frames are interconnected, the raised edges of each frame effectively provide a "filler" to the gap between the frames, which would have been created and would have required grouting. Now, with multiple frames interconnected with the filler edges, no gap is left and no grouting is needed.

Figure 3:
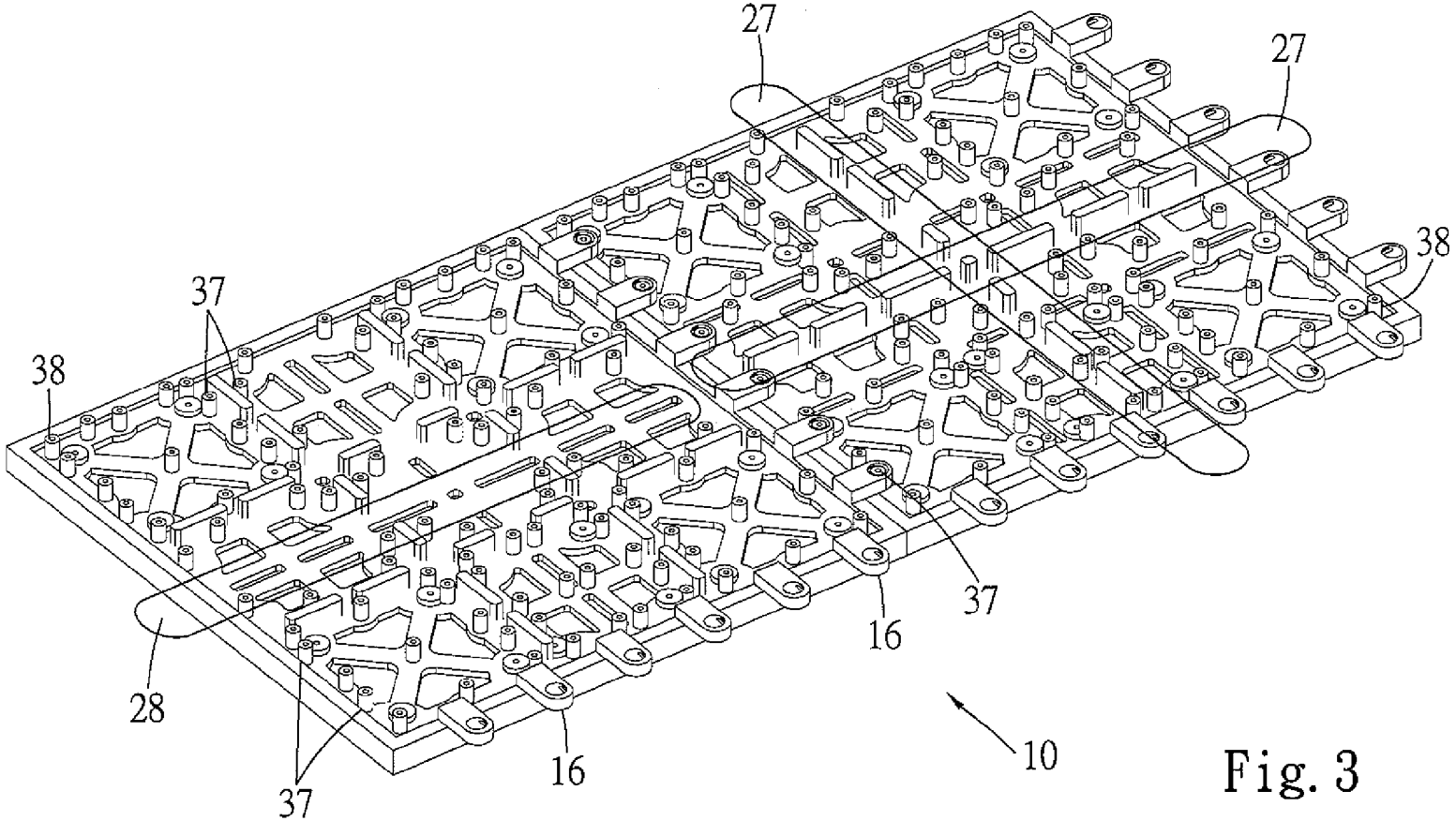
FIG. 3 shows the bottom view of the modular frame 10 interlocked with another modular frame 10.
Figure 4A:
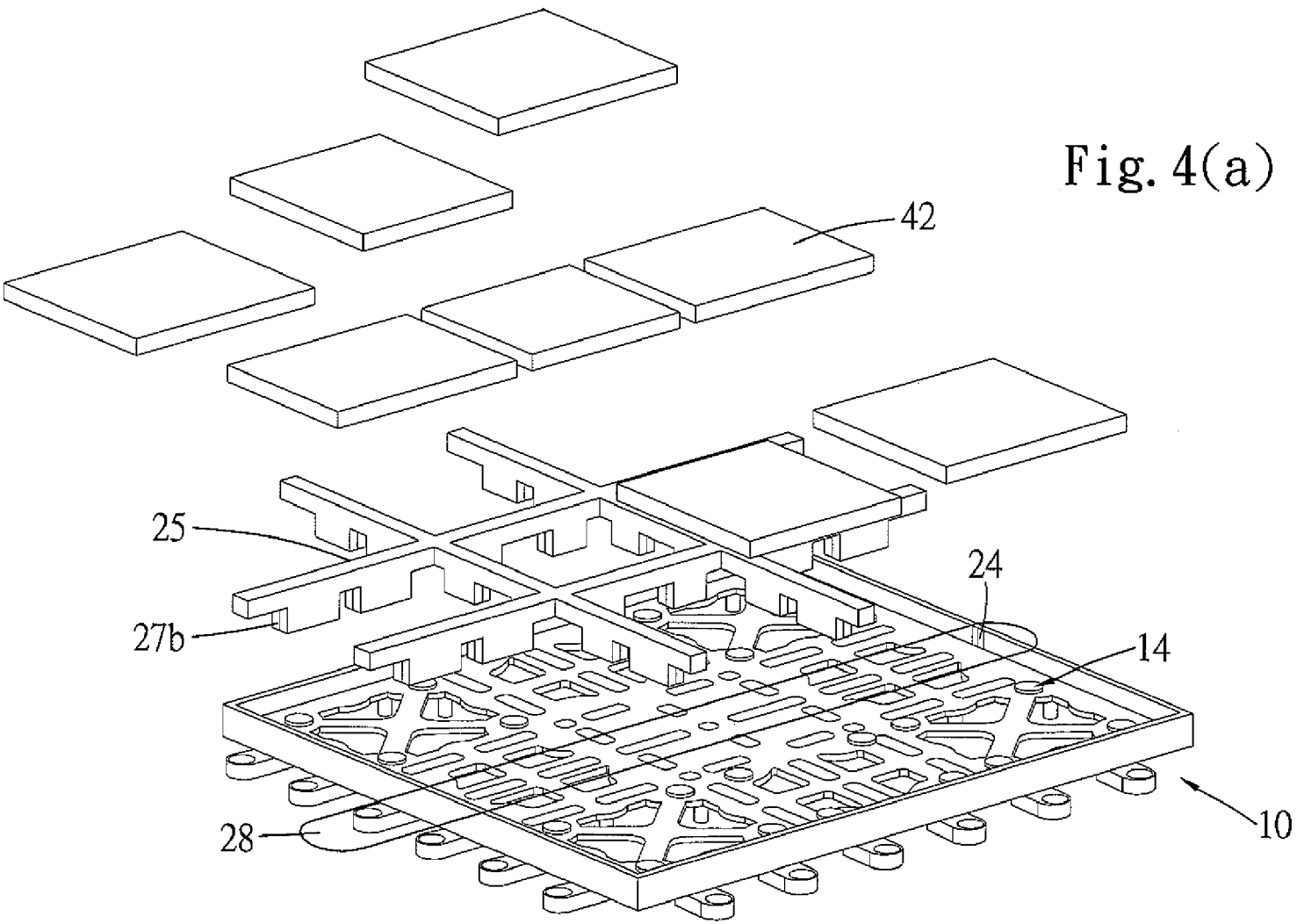
FIG. 4 (*a*) shows the frame 10 with another tile arrangement, where nine tiles 42 can be arranged and placed on the tray-shaped frame in a 3×3 fashion.
Figure 4B:
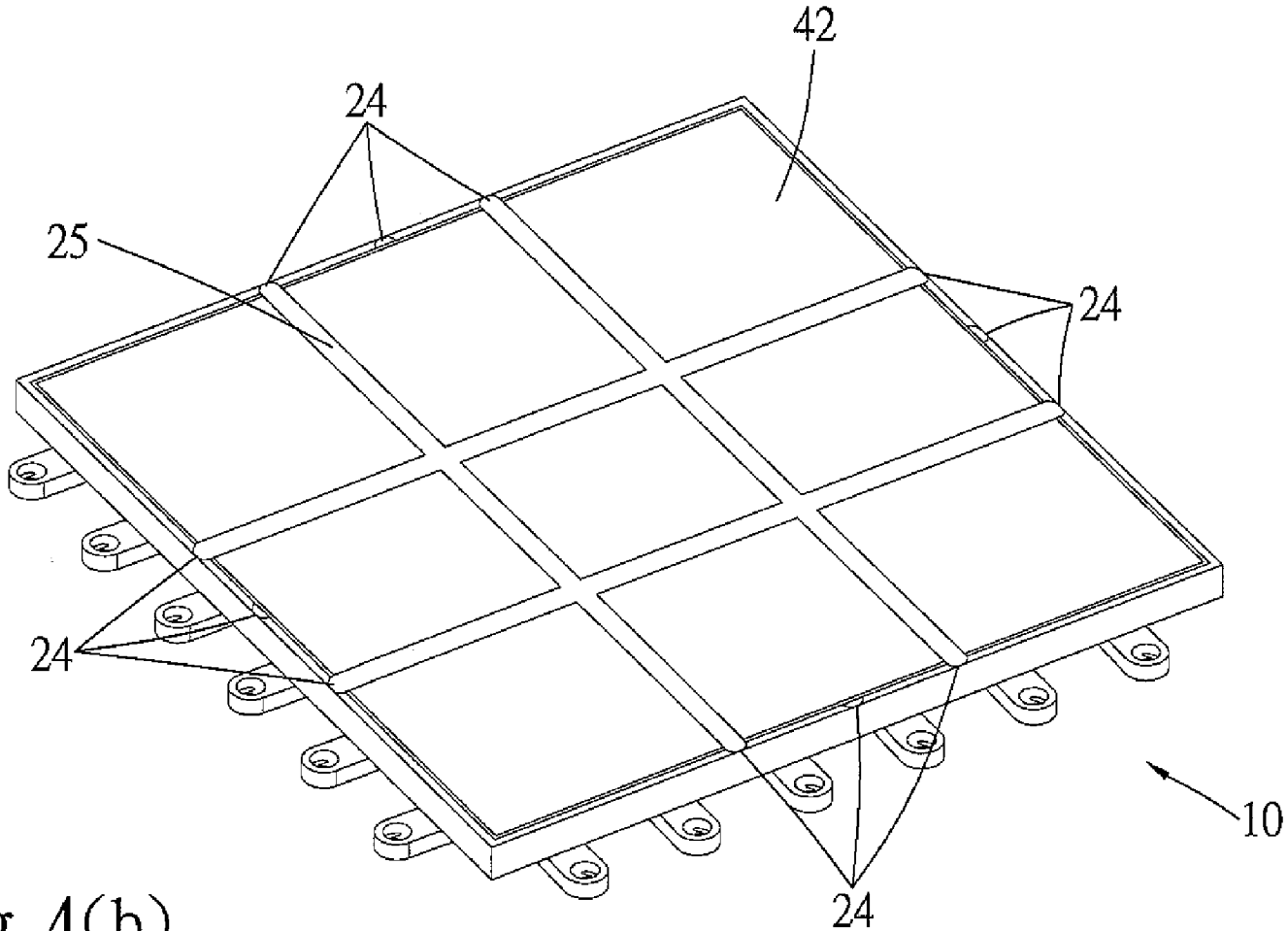
Figure 4C:
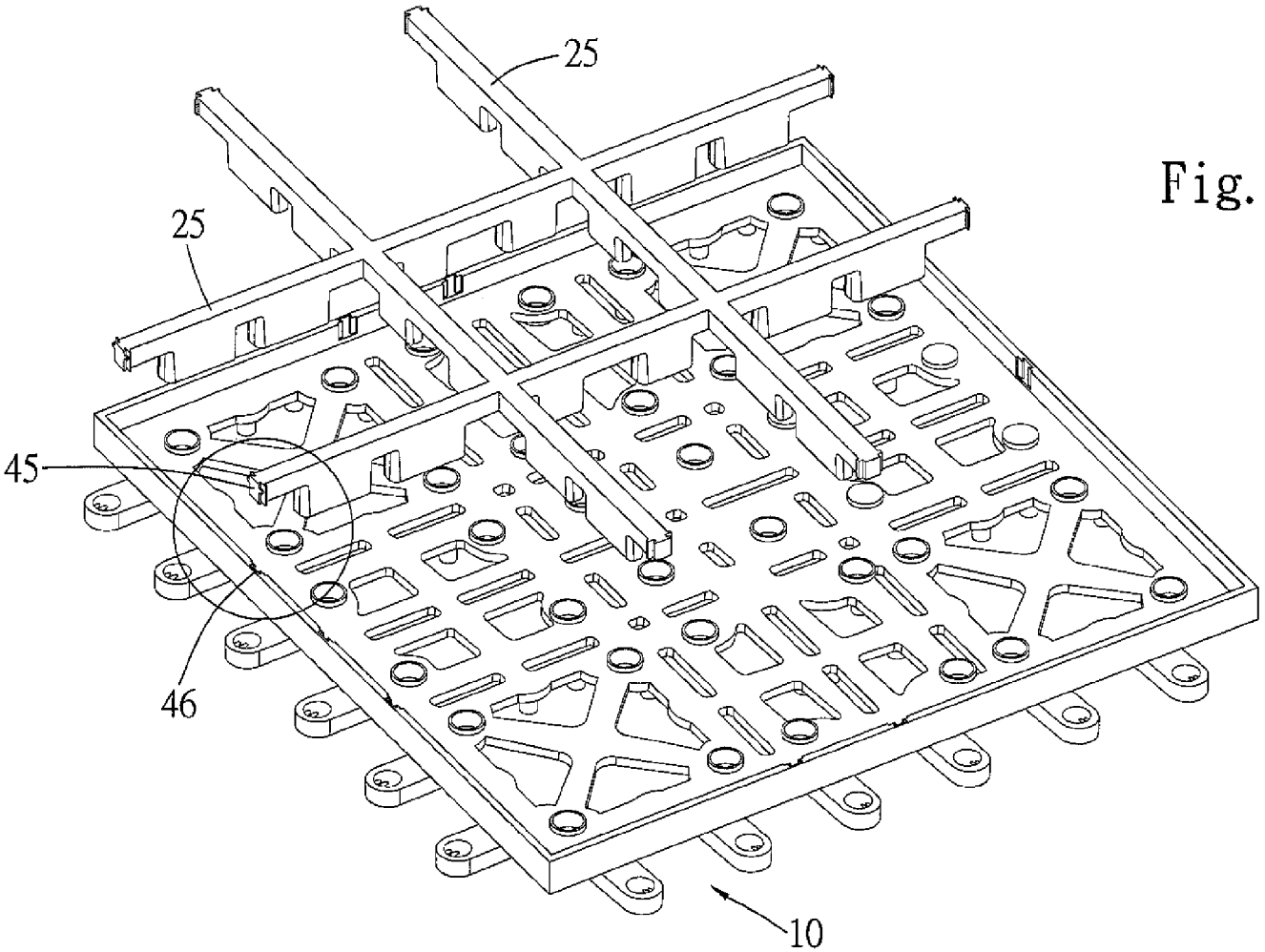
Figure 4D:
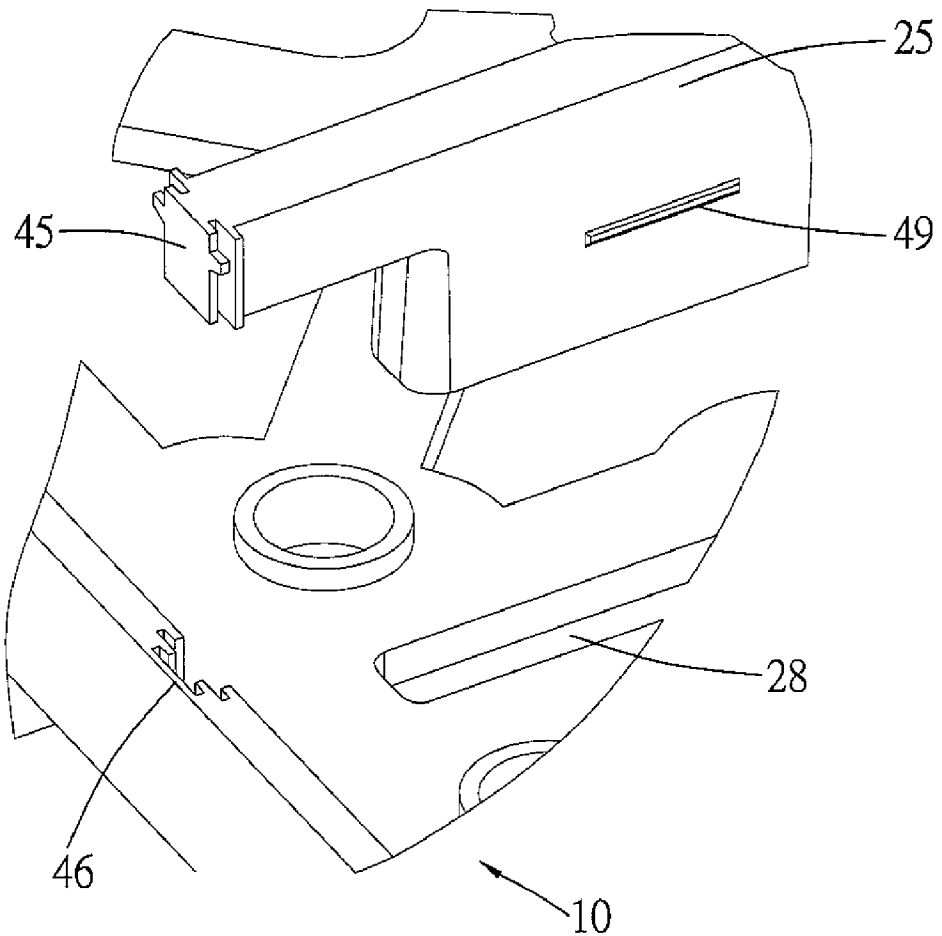

The frames may be made of light-weight sturdy material such as plastic. The bottom surface of the frames are implemented with an array of support legs, as shown in FIG. 3, to support the frames and tiles above the existing floor. The strength of the material and structure should be determined based on the intended use of the modular system, as can be appreciated by those skilled in the art. For example, the system for use in a garage should have a higher weight tolerance than those intended for only a patio or deck.

FIG. 1 (*b*) shows the bottom view of the frame 10. Legs 37 are shown formed in an array or grid pattern throughout the bottom of the frame 10, which are aligned with the bosses 16, so that the legs 37 and bosses 16 can be connected. The bottom of a filler frame 25 (to be described) is locked to the frame through the openings 28. The extension of the bottom also serves as additional support for the frame 10. Support legs 38 are positioned throughout the bottom of the frame 10 to provide uniform and distributed weight bearing. Nail or screw holes 18 are dispersed, which may also be used as the glue holes 14 if not used as nail/screw holes.

Figure 2A:
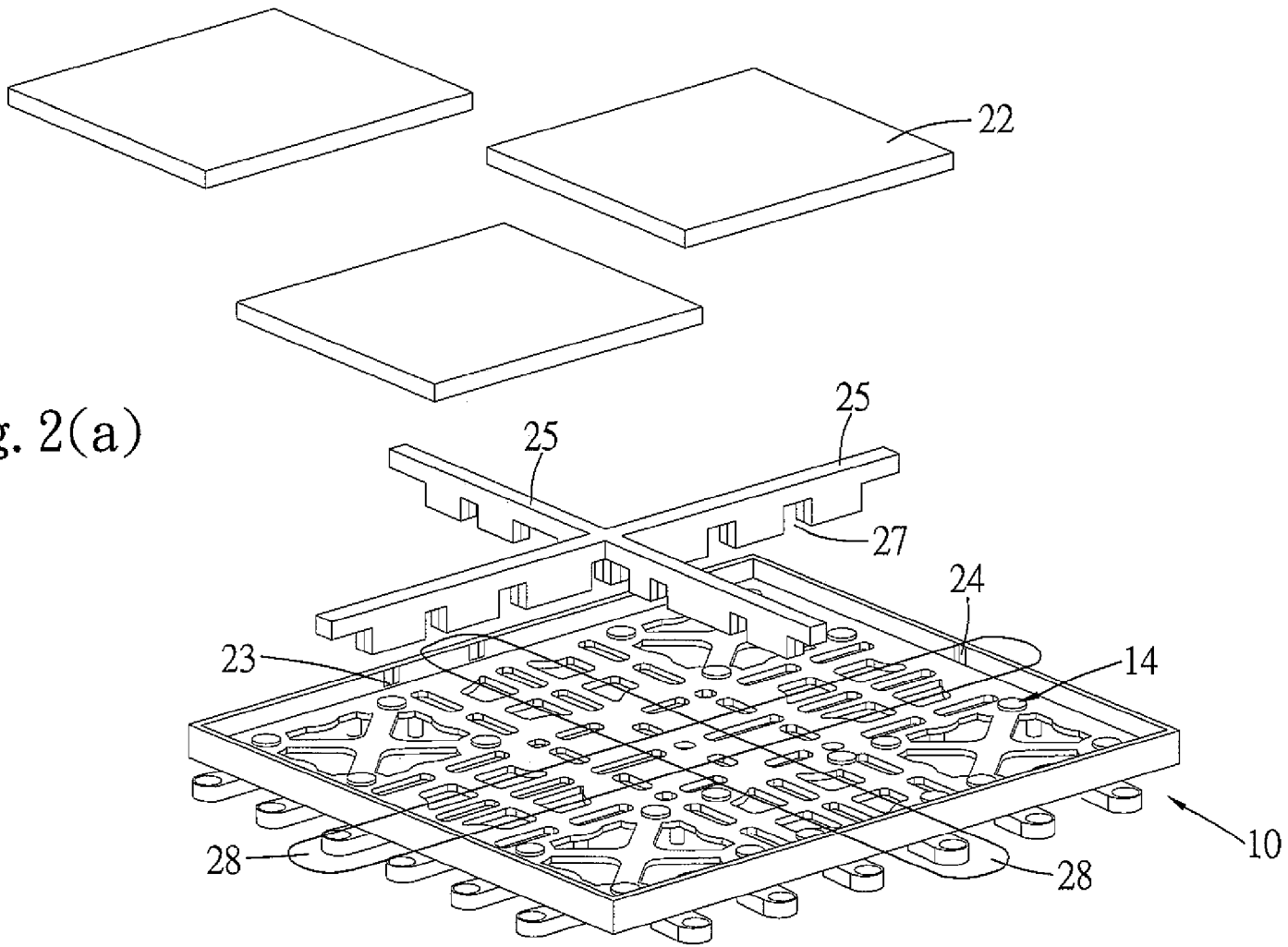
FIG. 2 (*a*) shows the modular frame 10 in more detail with a different tile arrangement.
Figure 2B:
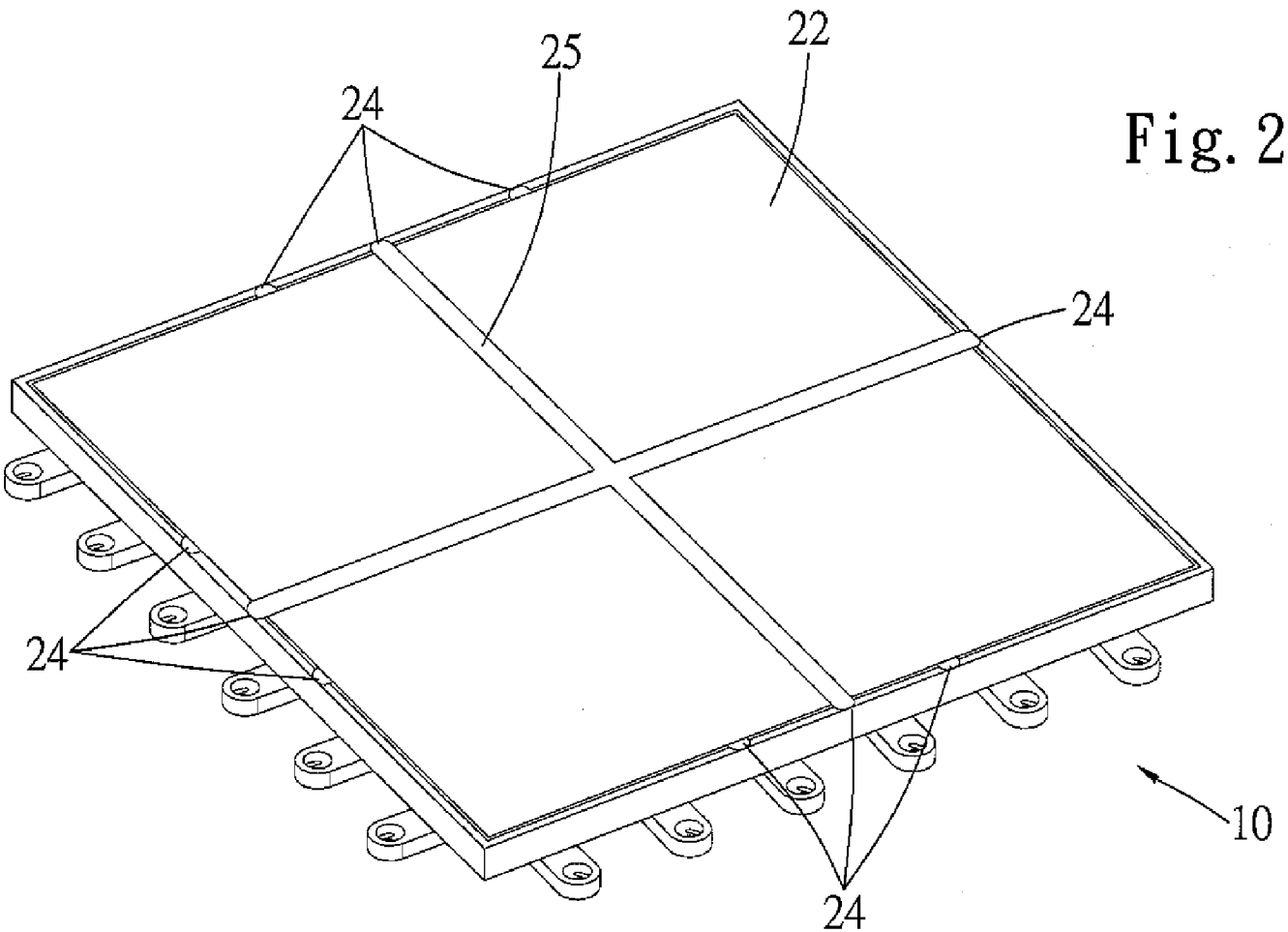

FIG. 2 (*a*) shows the modular frame 10 in more detail for use with a different tile arrangement. Instead of one single tile as shown in FIG. 1, a 2×2 arrangement can be achieved using four smaller tiles 22. A filler frame 25 is used as a divider and a stabilizer among the tiles 22. The filler frame 25 has notches 27 at its bottom for interlocking with corresponding openings 28 positioned on the frame 10. The filler frame 25, much in the same way as the raised edge on the frame 10, prevents the tiles from any lateral movement, as well as fill in the gaps among the tiles 22. A further benefit of the filler frame 25 is that it facilitates drainage to the bottom of the frame, which would have been impossible in the case of grouting. To further secure the filler frame 25 to the modular frame, notches (or indentations) 23, 24 are provided on the inside surface of the raised edges of the frame 10. Multiple notches, or indentations, may be provided to accommodate different filler frames. For example, a filler frame for a 2×2 arrangement preferably needs one notch on each side, but a 3×3 (FIG. 4 (*a*), 4 (*b*)) preferably need two notches on each side.

FIG. 2 (*b*) shows the 2×2 arrangement of tiles 22 in the "tray-shaped" frame 10. The filler frame 25 serves as a "gap-filler" as well as a stabilizer.

FIG. 3 shows the bottom view of the modular frame 10 interlocked with another modular frame 10. The two frames are shown connected by inserting the legs 37 through the corresponding bosses 16 on the side of the frames. Additional legs 37 are placed at different locations of the frame so that the frames may be trimmed, while the legs 37 are still available for the bosses 16. The notches 27 from the bottom of filler frame 25 are shown reaching through the openings 28 under the frame 10 to secure the filler frame 25 to the frame 10. For the legs 38 that are not utilized, they also serve as the support. In other words, the support legs 38 not only provide interconnection, but also provide support.

FIG. 4 (*a*) shows the frame 10 with another tile arrangement, where nine tiles 42 can be arranged and placed on the tray-shaped frame in a 3×3 fashion. Instead of the "+" shaped filler frame, the filler frame 25 is now a "#" shaped divider. Notches 27*b* may be implemented at the bottom side of one or more segments of the filler frame 25 to allow interlocking between the filler frame 25 and the frame 10. To receive the notches 27*b*, the frame 10 has openings 28 already in place to receive the notches 27*b*, in the patterns of "+" or "#", depending on the filler frame used. Notches 24, or indentations, on the inside surface of the raised edge of the frame allow the filler frame 25 to be further secured to the frame 10. To accommodate different filler frames, e.g. "+"- or "#"-shaped, one or more notches or indentations may be positioned. Of course, different notches 24 and different openings 28 may be provided depending on the shape of the filler frame, e.g. "X"- or "O"-shaped.

FIG. 4 (*b*) shows the 3×3 arrangement of tiles in the frame 10. Note that the filler frame 25 is engaged and locked to the frame 10 at notches/indentations 24 around the perimeter of the frame 10. However, it should be noted that the filler fame 25 has only 2 contact points with the notches 24 on each side of the frame. Each side may be initially built for three notches, thus accommodating a 2×2 filler frame or a 3×3 filler frame.

FIGS. 4 (*c*)-(*d*) show the 3×3 arrangement in closer detail. The end notch 45 on the filler frame 25 may have a complementary engagement to the notch 46 to ensure a secured fit. Also, a strip of protrusion 49 may be implemented on the side of the filler frame 25 so that when the filler frame is inserted through the openings 28 on the frame 10, the protrusion 49 ensures the secure lock between the filler frame and the frame.

Figure 5:
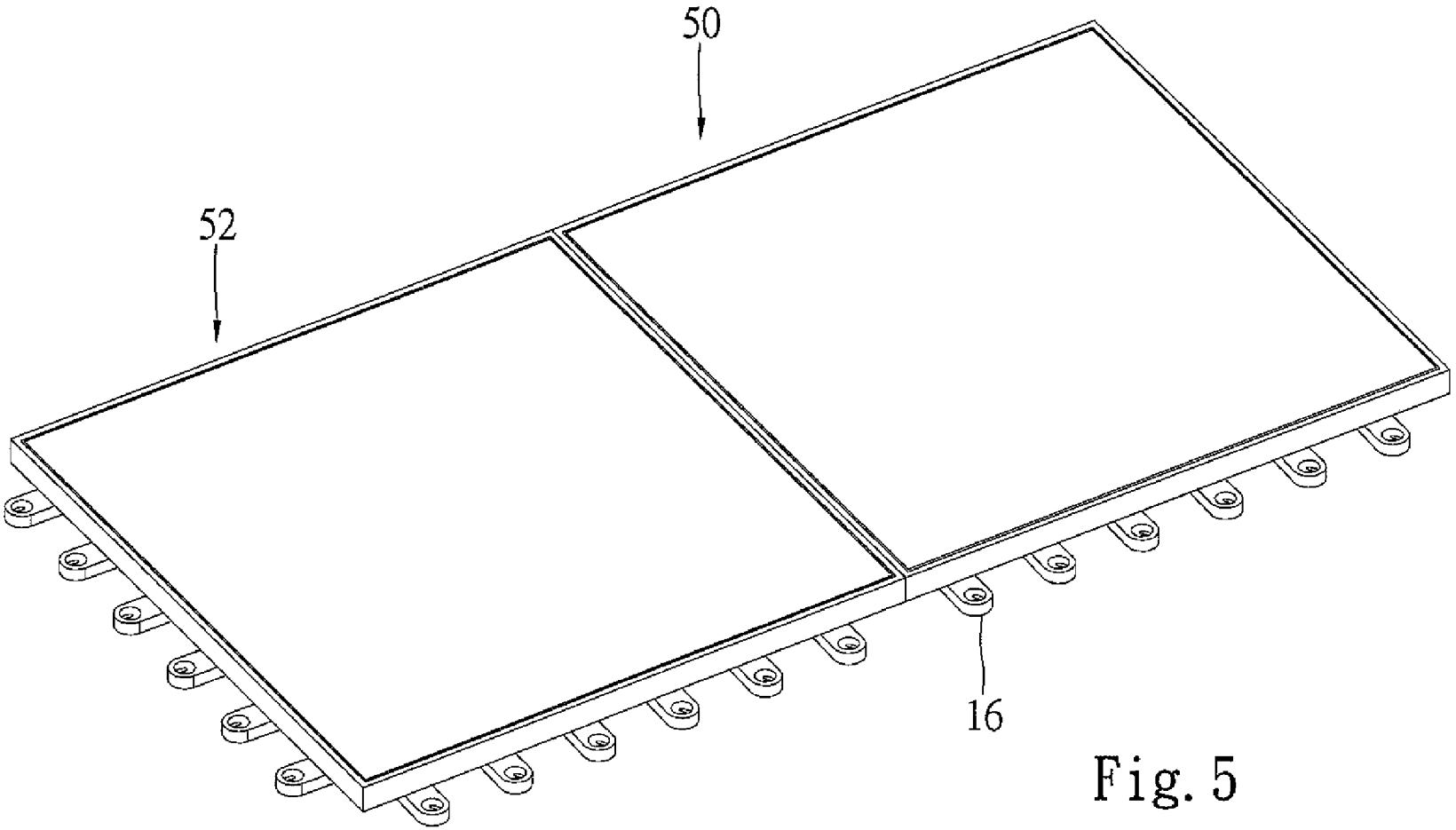
FIG. 5 shows an interlocked single-to-single arrangement, where the bosses 16 on the frame 50 are interlocked to the legs.

FIG. 5 shows an interlocked single-to-single arrangement, where the bosses 16 on the frame 50 are interlocked to the legs (not shown) underneath the frame 52.

Figure 6:
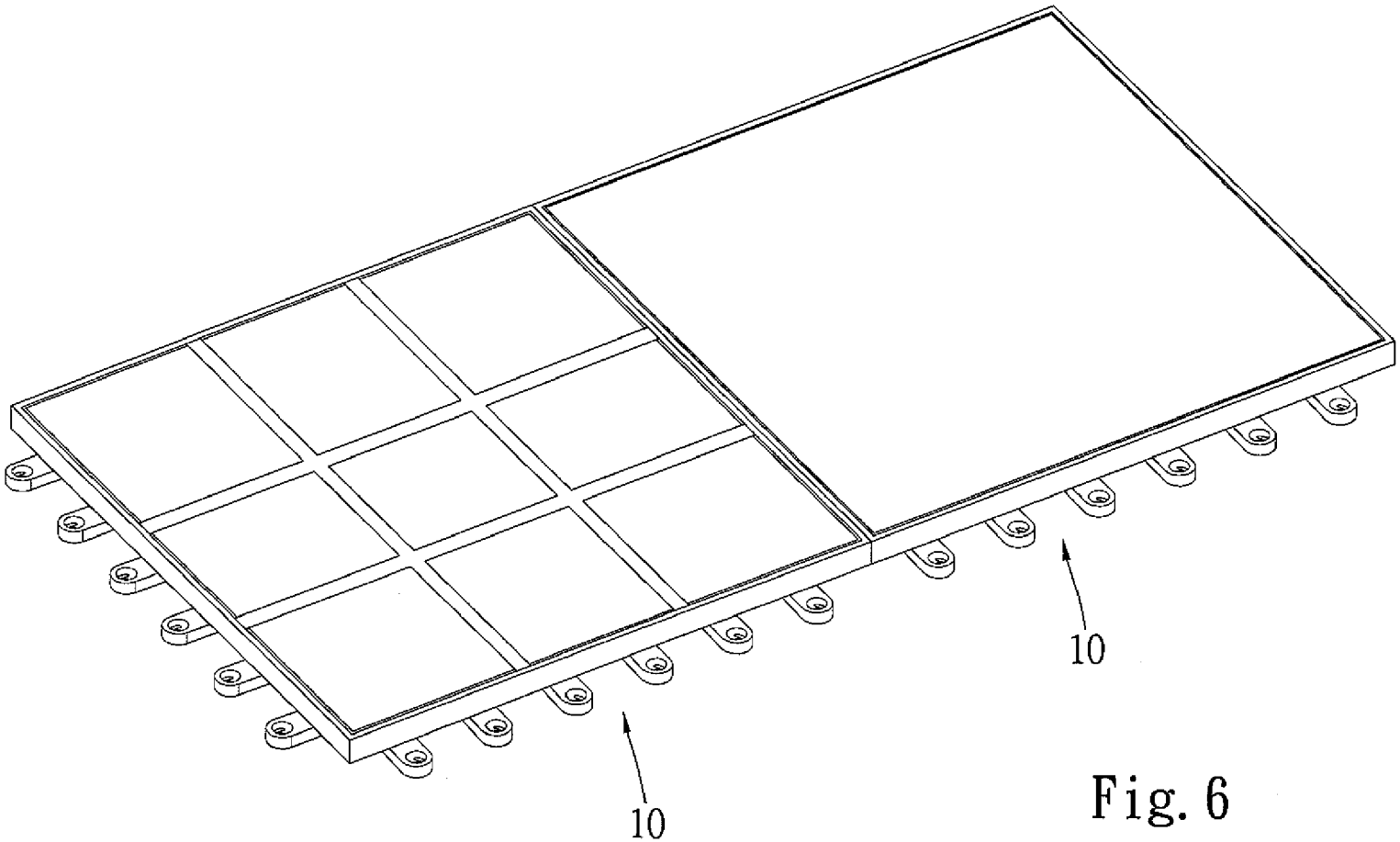
FIG. 6 shows an interlocked single-to-3×3 arrangement, where a frame with a single tile is connected to a frame with a 3×3 arrangement.

FIG. 6 shows an interlocked single-to-3×3 arrangement, where a frame with a single tile is connected to a frame with a 3×3 arrangement. As can be appreciated by those skilled in the art, the use of the modular frame 10 allows virtually unlimited combination of tile arrangements.

Figure 7:
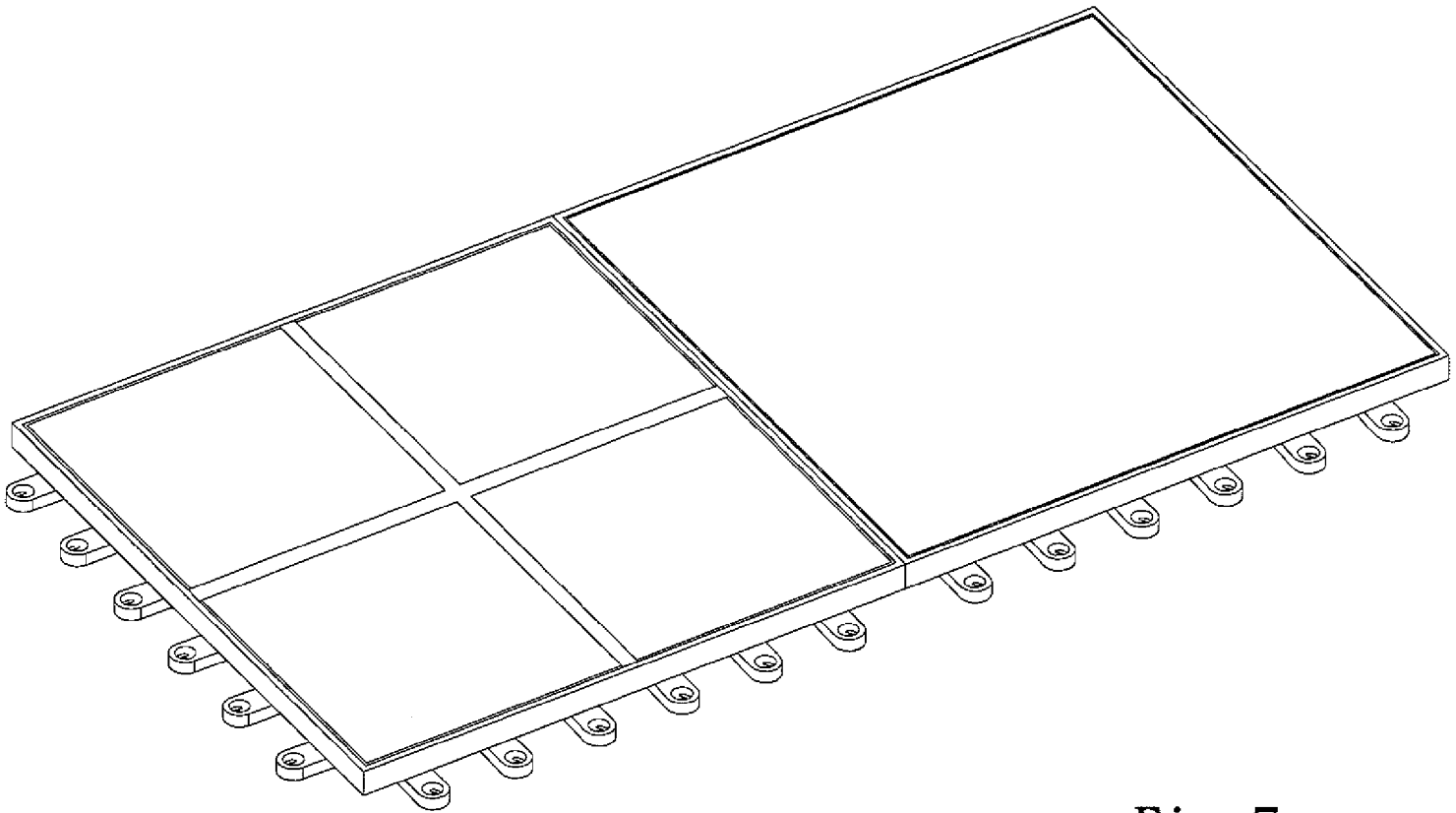
FIG. 7 shows an interlocked single-to-2×2 arrangement.

FIG. 7 shows an interlocked single-to-2×2 arrangement.

Figure 8:
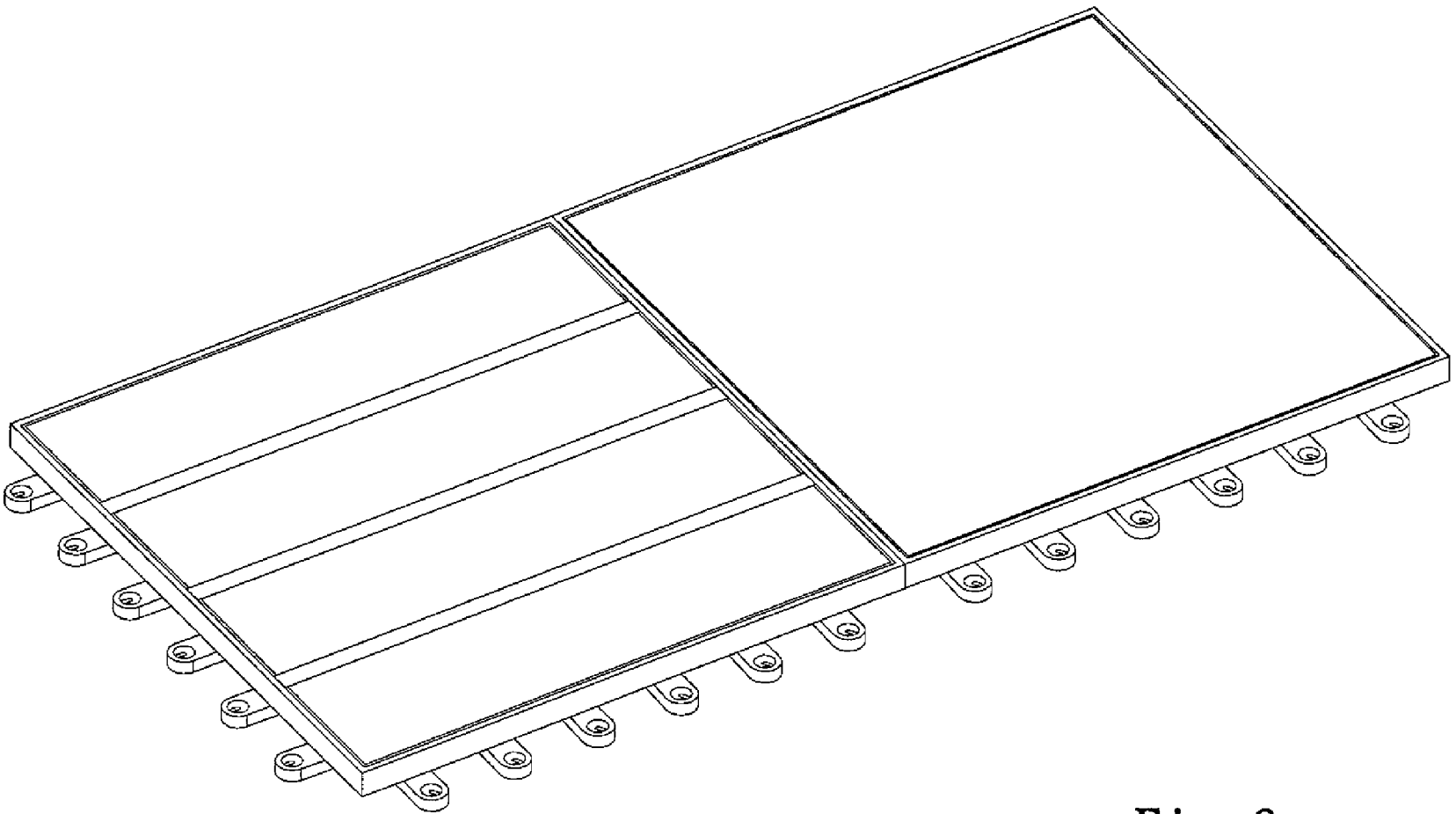
FIG. 8 shows an interlocked single-to-wood plank arrangement.

FIG. 8 shows an interlocked single-to-wood plank arrangement.

Figure 9A:
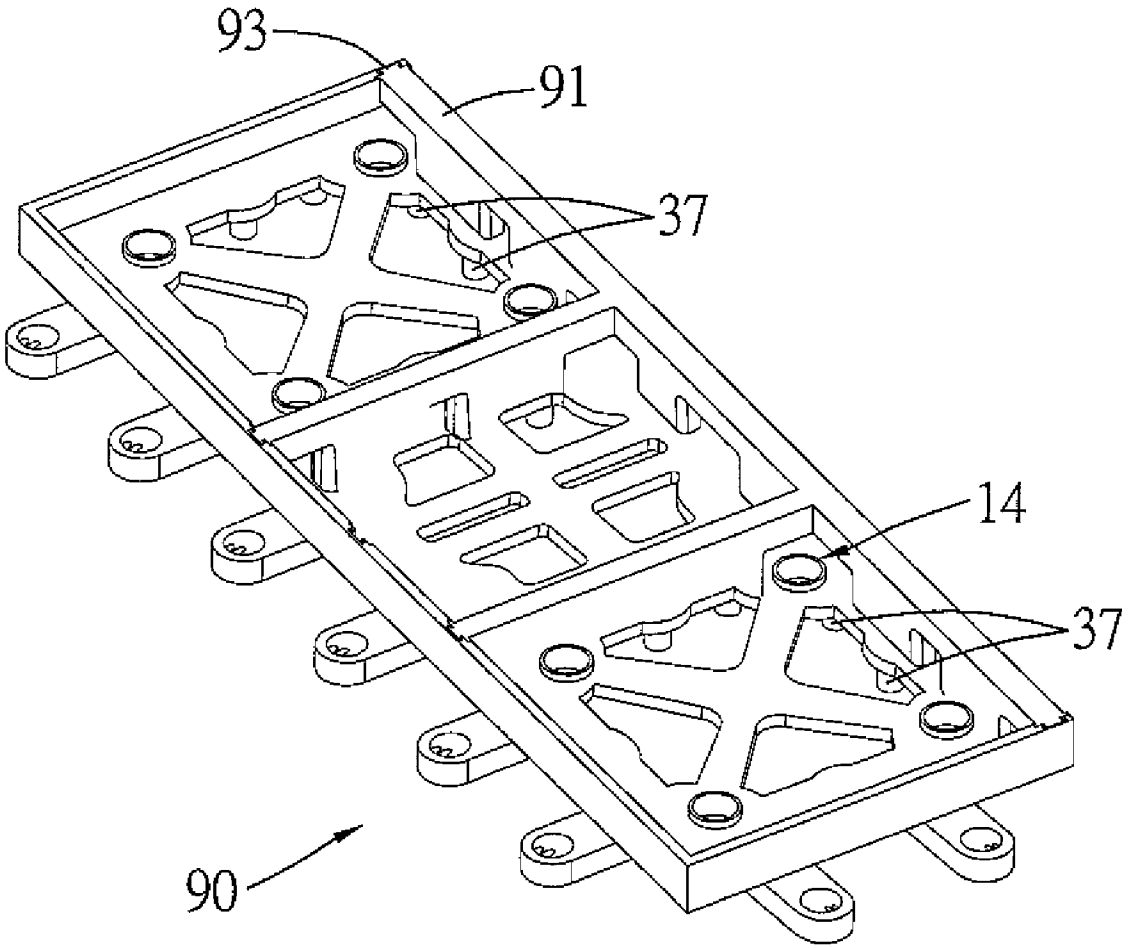
FIGS. 9 (*a*), (*b*) and (*c*) show a cut frame 90, which can still be interlocked to the full frame 10.
Figure 9B:
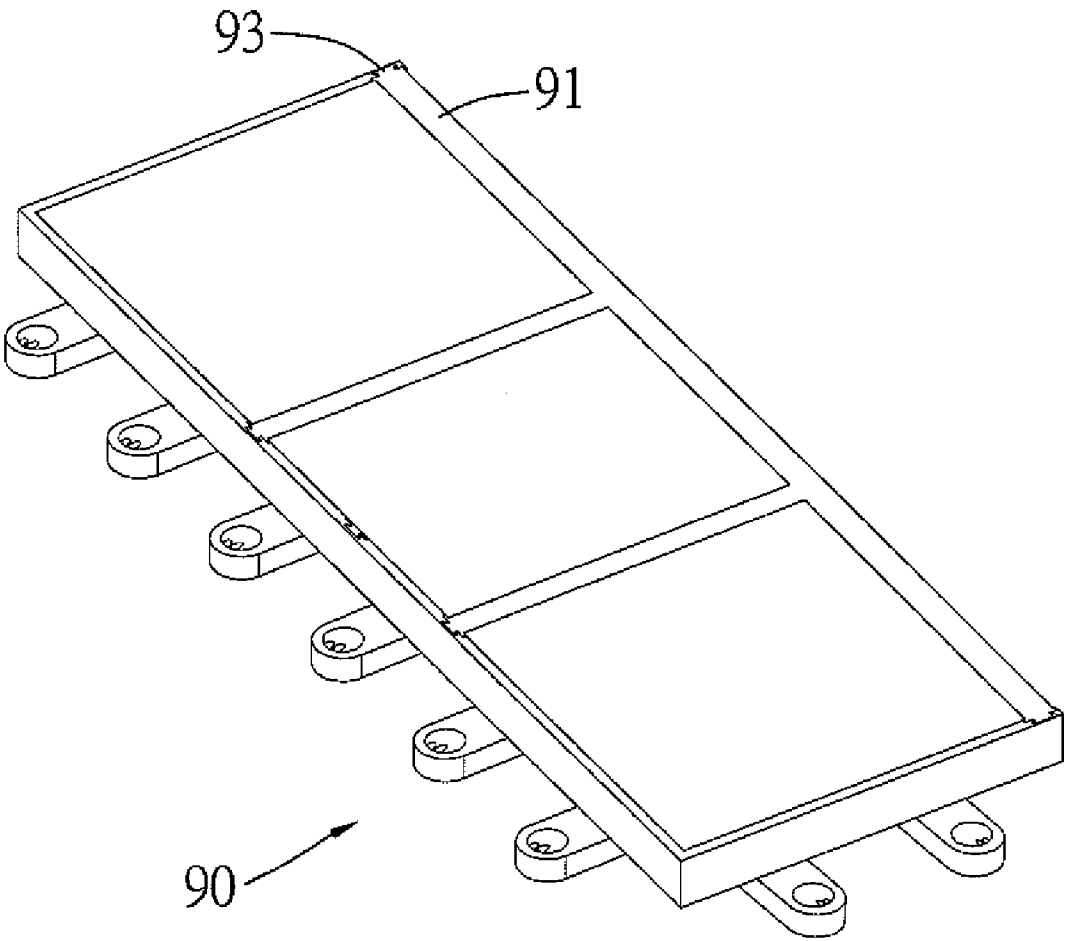
Figure 9C:
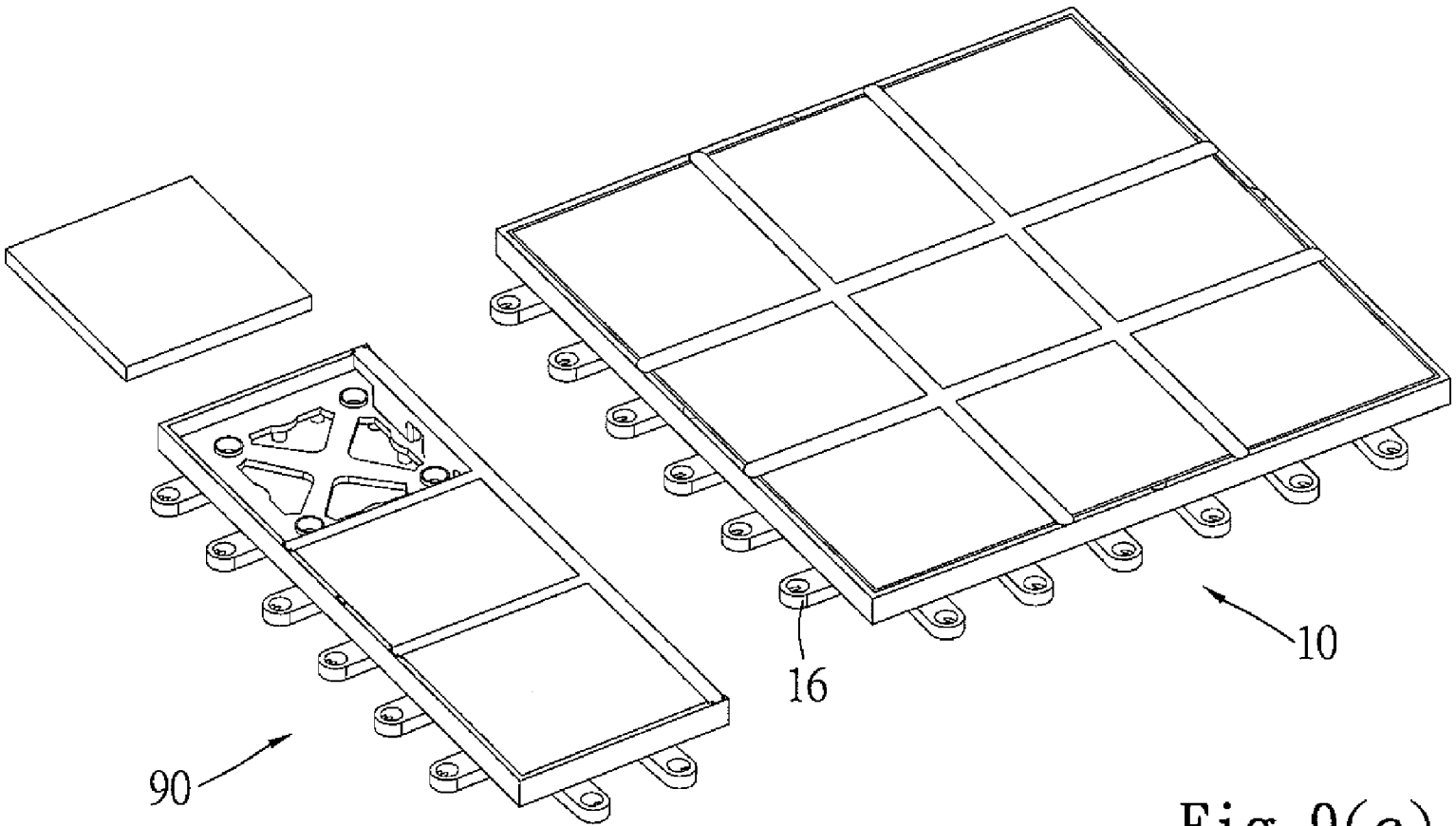

FIGS. 9 (*a*), (*b*) and (*c*) show a cut frame 90, which can still be interlocked to the full frame 10, since the cut frame 90 still has its legs 37 underneath the frame for connection to the bosses 16. In the case of conventional frames, no legs would have been available for such arrangement. Also, it is noted that the cut frame 90 can still keep a part of the filler frame 91 in place, so as to provide lateral stability to the tiles. The filler frame 91 still can take advantage of the notch/indentation 93 on the frame 90. Glue holes 14 are used to provide adhesive to the tile.

Figure 10:
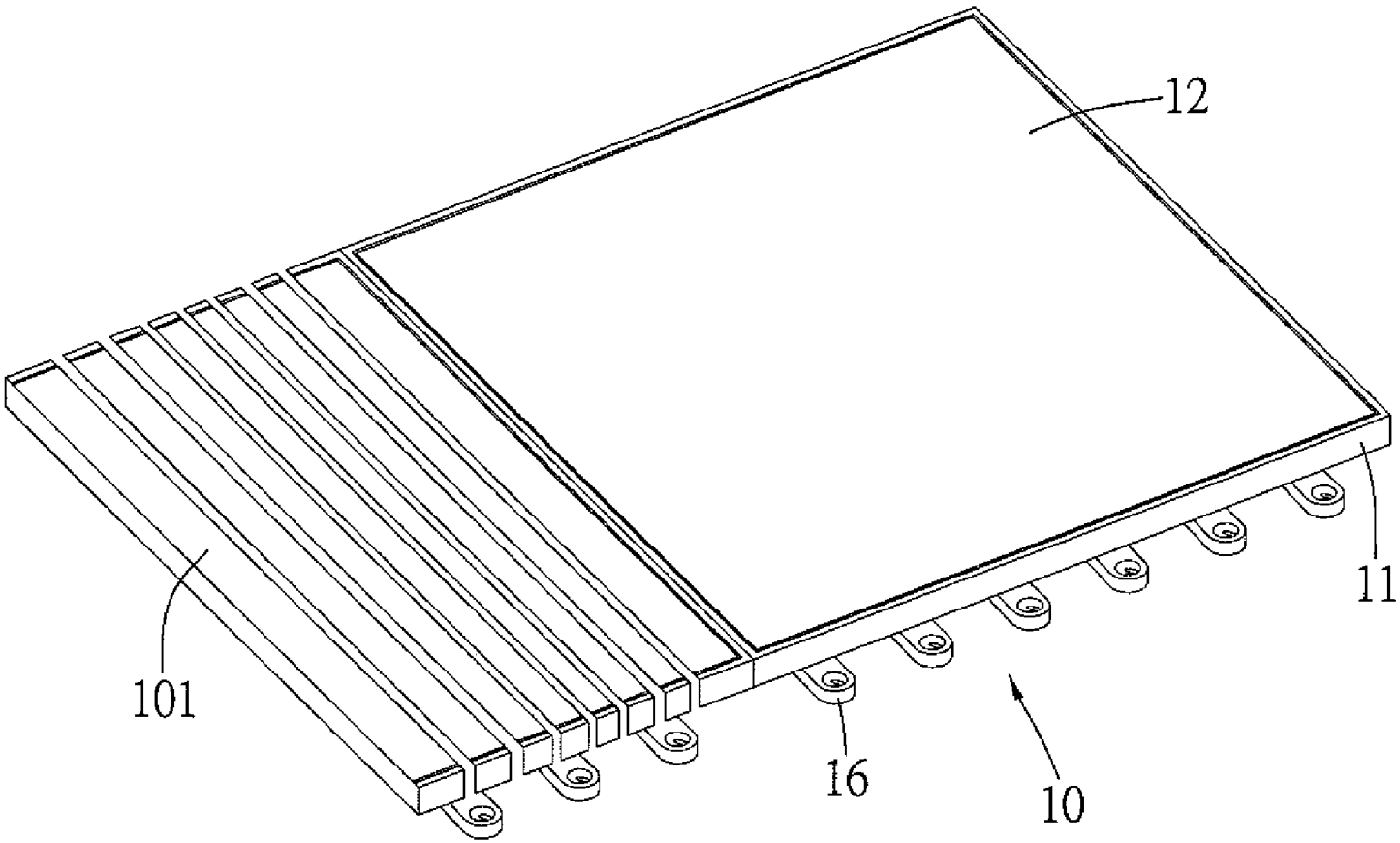
FIG. 10 shows an arrangement of a base frame interlocked with an edge trim or edge cap.

FIG. 10 shows an arrangement of a base frame 10 interlocked with an edge trim/edge cap 101. As previously described, support legs 37 (not shown) are formed underneath the frame 10 in an array or grid pattern, instead of being only in the perimeter. Even when the base frame 10 is cut or trimmed, other legs in the grid are still available for making connection with the bosses 16 of the other frames. Also, an edge trim 101 can be used as an edge trimmer, a drainage frame or transition frame. The edge trim 101 can be cut or trimmed and be connectable at all sides, through its support legs or the bosses. The edge trim 101 may be placed in the middle of the tile system to improve drainage or as on intermediate piece to connect to another tile design.

Although this invention has been described with reference to these specific embodiments, the descriptions are intended to be illustrative of the invention and are not intended to be limiting. Various modifications and applications may occur to those skilled in the art without departing from the true spirit and scope of the invention.

What is claimed is:

1. A modular frame for a system of tiles comprising:

a planar member defined by a perimeter having four sides, a top surface and bottom surface;

on each side of said perimeter, a flange projection upwardly from the top surface, for containing tiles placed on the planar member;

a plurality of downwardly projecting support legs of common length dispersed on the bottom surface in an array pattern;

a plurality of connection bosses extending outside the perimeter of the planar member from at least one side of the planar member, for receiving a support leg of a like frame and thereby forming an interlock with the like frame;

a filler frame adapted to divide the top surface of the planar member into a predetermined pattern of subdivisions, said filler frame having a first notch for engaging the flange of the planar member and a second notch for engaging the top surface of the planar member, said filler frame having a height that is substantially the same as the height of the flange;

a plurality of notches on the inside surface of each flange for engaging the first notch of the filler frame; and a plurality of through-openings dispersed on the planar member for engaging the second notch of the filler frame.

2. The modular frame of claims 1, further comprising: a plurality of glue pockets on the top surface of the planar member for receiving adhesive material to bond the tiles when placed onto the frame.

3. The modular frame of claim 1, wherein said through-openings dispersed on the planar member are in a predetermined pattern to accommodate a plurality of filler frame designs.

4. A modular frame for tiles comprising:

a tray-shaped base frame, defined by a perimeter having four sides, a top surface and bottom surface, for holding at least one tile in place;

a plurality of support legs projection downwardly from the bottom surface, said support legs being positioned in a predetermined array pattern on the bottom surface;

a plurality of bosses projecting beyond the perimeter from at least one side of the base frame for receiving support legs from a like frame;

engagement notches formed on the tray-shaped base frame and on the surface; and a divider frame adapted to divide the top surface of the base frame into predetermined subdivisions, said divider frame having one least one elongated body having notches complementary to the engagement notches on the base frame and on the surface, for engaging to the base frame.

5. The modular frame of claim 4, wherein the support legs are also adapted to engage the bosses for interconnection.

6. The modular frame of claim 5, wherein said engagement notches on the surface are formed through the top and bottom surfaces for engaging the notches on the divider frame.

7. The modular frame of claim 6, wherein said engagement notices on the surface and on the base frame are formed at predetermined locations to accommodate a plurality of divider frame designs.

8. The modular frame of claim 4, wherein said base frame and said divider frame are adapted to be cut to fit a predetermined dimension.

9. A modular frame for tiles comprising:

a tray-shaped base frame, defined by a perimeter having four sides, a top surface and bottom surface, for holding at least one tile in place;

a plurality of support legs projecting downwardly from the bottom surface, said support legs being positioned in a predetermined array pattern on the bottom surface;

a plurality of bosses projecting beyond the perimeter from at least one side of the base frame for receiving support legs from a like frame;

engagement notches formed on the tray-shaped base frame and on the surface;

a plurality of glue pockets dispersed throughout the top surface of the base frame, the glue pockets being adapted to receive adhesives for bonding the tiles to the base frame; and a divider frame adapted to divide the top surface of the base frame into predetermined subdivisions, said divider frame having at least one elongated body having notches complementary to the engagement notches on the base frame and on the surfaces, for engaging to the base frame.

10. The modular frame of claim 9, wherein the support legs are also adapted to engage the bosses for interconnection.

11. The modular frame of claim 10, wherein said engagement notches on the surface are formed through the top and bottom surfaces for engaging the notches on the divider frame.

12. The modular frame of claim 11, wherein said engagement notices on the surface and on the base frame are formed at predetermined locations to accommodate a plurality of divider frame designs.

* * * * *